US006036025A

United States Patent [19]

Clark et al.

[11] Patent Number: 6,036,025

[45] Date of Patent: Mar. 14, 2000

[54] MINERAL FLOTATION SEPARATION BY DEOXYGENATING SLURRIES AND MINERAL SURFACES

[75] Inventors: David W. Clark, Gladesville; Andrew J. Newell, Chatswood, both of Australia

[73] Assignee: BOC Gases Australia Limited, New South Wales, Australia

[21] Appl. No.: 09/048,734

[22] Filed: Mar. 26, 1998

[30] Foreign Application Priority Data

Mar. 26, 1997 [AU] Australia ..... PO 5909

[51] Int. Cl.[7] ..... B03D 1/02; B03B 1/04; B03B 1/00

[52] U.S. Cl. ..... 209/164; 209/166; 209/167; 209/1

[58] Field of Search ..... 209/166, 167, 209/1, 164

[56] References Cited

U.S. PATENT DOCUMENTS

| | | |
|---|---|---|
| 1,045,970 | 12/1912 | Greenway . |
| 1,274,505 | 8/1918 | Bradford . |
| 1,279,040 | 9/1918 | Thomas . |
| 1,488,745 | 4/1924 | Ellis . |
| 1,505,323 | 8/1924 | Eberenz . |
| 1,505,324 | 8/1924 | Eberenz . |
| 2,154,092 | 4/1939 | Hunt . |
| 3,655,044 | 4/1972 | Delaney . |
| 5,411,148 | 5/1995 | Kelebek . |
| 5,653,945 | 8/1997 | Gathje . |

FOREIGN PATENT DOCUMENTS

| | | |
|---|---|---|
| 50588/93 | 5/1994 | Australia . |
| 1070034 | 1/1980 | Canada . |
| 2163688 | 5/1996 | Canada . |
| WO 92/13640 | 8/1992 | WIPO . |
| WO 96/01150 | 1/1996 | WIPO . |

OTHER PUBLICATIONS

Derwent Soviet Inventions Illustrated, Section 1, chemical, vol. W, No. 31, issued Sep. 9, 1975, Metallurgy, p. 3, SU 405247, (Glazunov et al.) Dec. 10, 1974 Abstract.

*Primary Examiner*—Thomas M. Lithgow

[57] ABSTRACT

A process for the separation of minerals of different mineralogical character. The process involves conditioning a milled slurry or a slurry of a flotation concentrate which contains a mixture of valuable sulfidic minerals and non-sulfidic gangue material with an inert/non-oxidizing gas and/or a reducing/deoxifying agent. The conditioning is conducted to achieve a controlled dissolved oxygen content or electrochemical reduction potential conducive to the separation of the valuable sulfidic mineral, non-sulfidic gangue material. The inert/non-oxidizing gas and/or reducing/deoxifying agent may be added to the slurry in a quantity sufficient to increase rejection of the non-sulfidic gangue minerals or to improve the selectivity between the valuable sulfidic minerals and non-sulfidic gangue minerals.

6 Claims, 1 Drawing Sheet

MINERAL FLOTATION SEPARATION BY DEOXYGENATING SLURRIES AND MINERAL SURFACES

FIELD OF THE INVENTION

This invention relates to the physical separation of minerals and, in particular, to the separation of minerals of different mineralogical character.

BACKGROUND OF THE INVENTION

Many ore bodies comprise a mixture of valuable sulfide minerals with a number of non-sulfide minerals, including carbonaceous minerals (e.g. graphite, carbon-based residues as exist in Mt Isa, Australia ore bodies), talcose minerals (e.g. talc, brucite etc. which are associated with Western Australian nickel deposits and the Woodlawn, New South Wales, Australia base metal deposit) as well as amphiboles.

The non-sulfide minerals have naturally hydrophobic characteristics. The degree of hydrophobocity varies according to mineral and ore type from weakly hydrophobic to strongly hydrophobic. As a result, these so-termed "gangue" minerals have a tendency to float and are very difficult to separate from other valuable minerals, notably the sulfide minerals, e.g. chalcopyrite ($CuFeS_2$), pentlandite ($(Ni,Fe)_9S_8$) and sphalerite (ZnS)). When present in mineral concentrates, these "gangue" minerals often attract penalty charges at the smelter and, indeed, may be the cause of rejection of the ore concentrate by the smelter.

In practice, two approaches to this problem exist, namely to minimize the flotation of the non-sulfide "gangue" minerals using specific reagents or, alternatively, to encourage flotation of the "gangue" minerals in a pre-flotation step prior to the flotation of the desired minerals.

In the first approach, reagents such as depressants (guar gum, carboxy methyl cellulose and the like) or dispersants, e.g. sodium silicate, are employed to minimize the flotation rate of the non-sulfidic minerals. In some cases, for example with copper-nickel-iron bearing ores, nitrogen is used as a flotation gas in combination with organic depressants. This tends to strengthen pyrrhotite depression and increase nickel recovery. While successful to some extent, the use of these organic depressants is non-specific and adversely affects the flotation behavior of the sulfide minerals in terms of metallurgy as well as froth structure. In addition, the use of such reagents is costly and, if it were possible, should be avoided.

Furthermore, the use of such reagents not only adversely affects flotation behavior, it affects downstream operations such as dewatering and settling of the minerals. Additionally, and particularly with depressants, there is a requirement to add more reagent at each stage of the separation process.

In the second approach, a separate flotation system is dedicated to the recovery of the naturally floating mineral. Reagents are added to prevent the flotation of the valuable sulfide minerals, however with varying degrees of success. Inevitably, there will be at least some loss of the valuable mineral with the gangue recovered from the pre-flotation system. Such losses represent an economic disincentive and should ideally be avoided.

The applicants have previously attempted to address this problem by providing a pre-flotation treatment in which the major proportion of the non-sulfidic or naturally floating materials are separated from the valuable sulfidic mineral prior to the primary flotation step. In this process, which is subject of Australian patent application no 28746/95, a mineral slurry is subjected to a sequence of mineral dressing operations in which an inert gas and/or reducing agent are added to the slurry to maintain an electrochemical potential conducive to the separation of the minerals by flotation.

However, apart from the requirement of an additional pre-float stage, such pre-flotation may adversely affect the recovery of the valuable sulfidic mineral in the subsequent primary flotation step.

It has been previously reported that nitrogen, with and without organic depressants, may have an effect in the recovery of nickel. These previous disclosures, however, generally use nitrogen as a flotation agent to maximize sulfide flotation, e.g. pyrrhotite, pentlandite or pyrite which has nickel, cobalt or some precious metals associated therewith. Increasing quantities of depressants are required to provide effective separation of the nickel and pyrrhotite for example.

In an effort to ameliorate at least some of the disadvantages of the prior art it is proposed to provide a method for conditioning a slurry or flotation concentrate which improves the separation of valuable sulfidic minerals from non-sulfidic "gangue" material.

SUMMARY OF THE INVENTION

In a first aspect, the present invention provides a method of treating a milled slurry or slurry of a flotation concentrate having a mixture of valuable sulfidic mineral and non-sulfidic gangue material wherein the slurry is conditioned with at least one of an inert, non-oxidizing gas and a reducing, deoxifying agent to achieve a controlled dissolved oxygen content or electrochemical reduction potential conducive to the flotation of the valuable sulfidic material from the non-sulfidic gangue material, followed by flotation of the valuable sulfidic mineral from the non-sulfidic gangue material using an inert, non-oxidizing gas as the flotation gas, the conditioning step being conducted simultaneously with or prior to the flotation step.

In a preferred embodiment, the amount of conditioning substance, i.e. inert, non-oxidizing gas and/or reducing, deoxifying agent added to the slurry is sufficient to increase rejection of the non-sulfidic gangue minerals in a subsequent flotation step. Alternatively, the amount of conditioning substance added is sufficient to improve selectivity between the valuable sulfide minerals and non-sulfide gangue minerals.

DETAILED DESCRIPTION OF THE INVENTION

Figure 1:
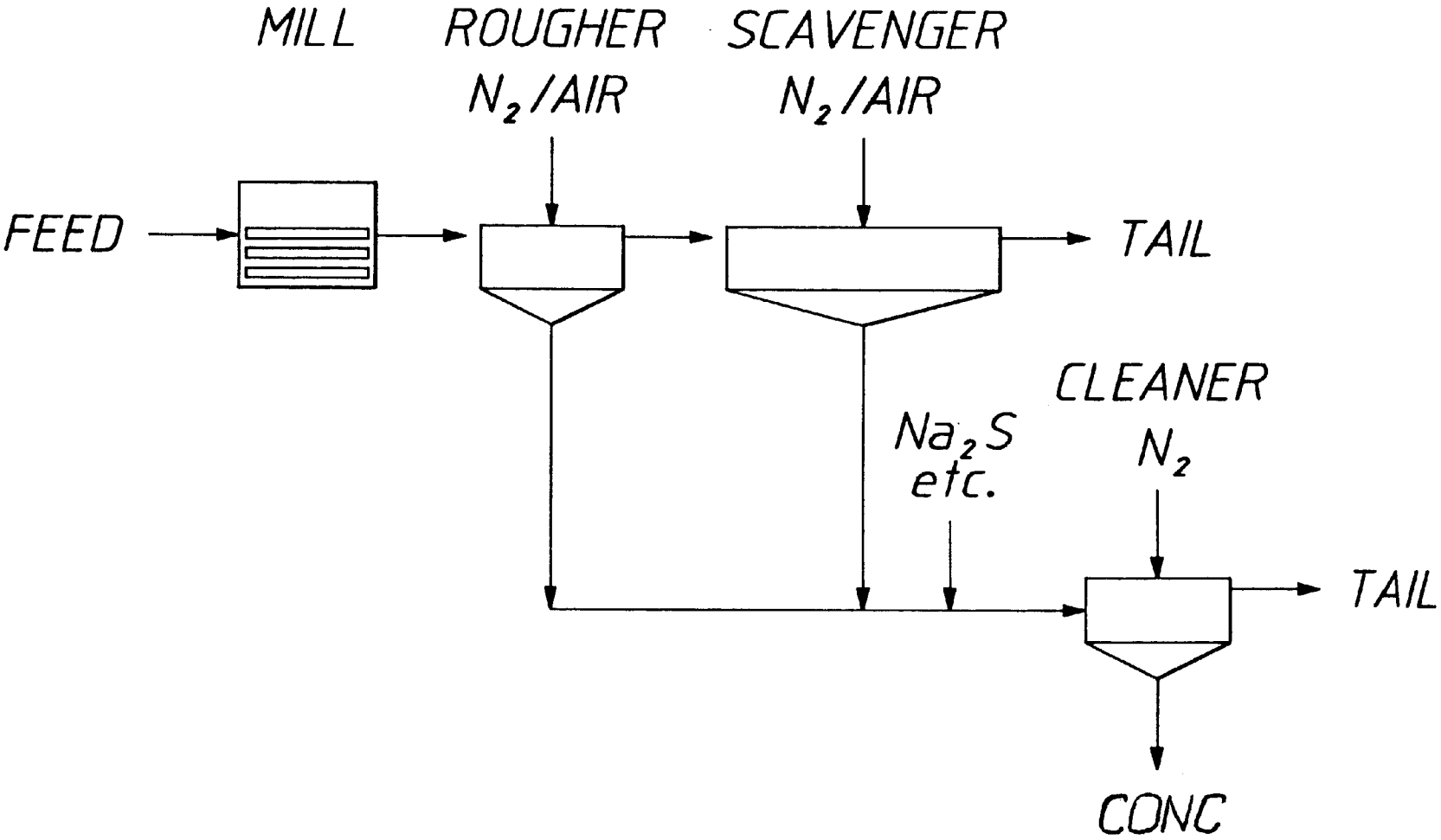
FIG. 1 is a flow diagram of a typical flotation circuit in accordance with an embodiment of the present invention.

The method of treating a slurry or flotation concentrate having a mixture of valuable sulfidic mineral and non-sulfidic gangue material in accordance with the present invention is premised upon the discovery that non-sulfidic gangue minerals have an affinity for oxygen. Oxidation or attachment of oxygen to talc, for example, renders the material even more hydrophobic i.e. floatable, than in its natural state. Therefore, the inventive method for conditioning a milled slurry or slurry of a flotation concentrate from a previous flotation cell overcomes at least some of the difficulties associated with the naturally floatable non-sulfide gangue minerals. Not wishing to be bound by any particular theory, the applicants believe such a conditioning step with nitrogen or other inert, non-oxidizing gas, and optionally a reducing agent, creates an environment which physically and chemically removes oxygen from non-sulfide gangue minerals. This subsequently improves their rejection in the flotation process while not adversely affecting the recovery of the valuable sulfide minerals.

Suitable non-sulfide gangue materials which may be subjected to the present invention include magnesium bearing minerals, talc, lizardite, brucite etc. and others such as antigorite, chlorite, certain micas, amphiboles and the like and generally other so-called naturally floating minerals.

TABLE 1

| TYPE | MAJOR MINERALS* | METALS EXTRACTED | EXAMPLES |
|---|---|---|---|
| ORES RELATED TO MAFIC AND ULTRAMAFIC INTRUSIONS | | | |
| Sudbury nickel-copper | po, pn, py, cpy, viol | Ni, Cu, Co, PGM | Sudbury, Ontario |
| Merensky reef platinum | po, pn, cpy | Ni, Cu, PGM | Merensky Reef South Africa<br>JM Reef Montana |
| ORES RELATED TO FELSIC INTRUSIVE ROCKS | | | |
| Tin and tungsten skarns | py, cass, sph, cpy, wolf | Sn, W | Pine Creek, California |
| Zinc-lead skarns | py, sph, gn | Zn, Pb | Ban Ban, Australia |
| Copper skarns | py, cpy | Cu, Au | Carr Fork, Utah |
| Porphyry copper/molybdenum | py, cpy, bn, mbd | Cu, Mo, Au | Bingham Canyon, Utah<br>Climax, Colorado |
| Polymetallic veins | py, cpy, gn, sph, ttd | | Camsell River, NWT |
| ORES RELATED TO MARINE MAFIC EXTRUSTVE ROCKS | | | |
| Cyprus-type massive sulfides | py, cpy | Cu | Cyprus |
| Besshi-type massive sulfides | py, cpy, sph, gn | Cu, Pb, Zn | Japan |
| ORES RELATED TO SUBAERIAL FELSIC TO MAFIC EXTRUSIVE ROCKS | | | |
| Creede-type epithermal veins | py, sph, gn, cpy, ttd, asp | Cu, Pb, Zn, Ag, Au | Creede, Colorado |
| Almaden mercury type | py, cinn | Hg | Almaden, Spain |
| ORES RELATED TO MARINE FELSIC TO MAFIC EXTRUSIVE ROCKS | | | |
| Kuroko type | py, cpy, gn, sph, asp, ttd | Cu, Pb, Zn, Ag, Au | Japan |
| ORES IN CLASSIC SEDIMENTARY ROCKS | | | |
| Quartz pebble conglomerate gold-uranium | py, uran, Au | Au, U | Witwatersrand, South Africa |
| Sandstone-hosted lead-zinc | py, sph, gn | Zn, Pb, Cd | Laisvall, Sweden |
| Sedimentary exhalative lead-zinc (Sedex) | py, sph, gn, cpy, asp, ttd, po | Cu, Pb, Zn, Au, Ag | Sultivan, BC<br>Tynagh, Ireland |
| ORES IN CARBONATE ROCKS | | | |
| Mississippi Valley type | py, gn, sph | Zn, Pb, Cd, Ga | SE Missouri |

*ABBREVIATIONS used as follows: po = pyrrhotite, pn = pentlandite, py = pyrite, cpy = chalcopyrite, viol = violarite, cass — cassiterite, sph = sphalerite, wolf = wolframite, gn = galena, bn = bornite, mbd = molybdenite, ttd = tetrahedrite, asp = arsenopyrite, cinn = cinnabar, uran = uraninite The conditioning step can be conducted simultaneously with or prior to the flotation step. To explain, as will be clear to persons skilled in the art, flotation may be carried out in a mechanical flotation vessel or a pneumatic column. Such vessels and columns can have substantial residence times. While a milled slurry or slurry of a flotation concentrate is resident in the flotation vessel or column, conditioning may be effected. Indeed, some flotation machines lend themselves to being used for conditioning prior to or simultaneously with the flotation step.

The inventive process is suitable for ores related to mafic and ultramafic intrusions typically containing metal sulfides and precious metals and non-sulfide gangue minerals. Suitable ores for application of the process are shown in Table 1. Specifically, the inventive process is particularly suitable for recovery of nickel eg millerite, valerite, pentlandite; copper eg chalcopyrite, chalcocite; precious metals such as gold, silver, platinum group metals (pgms) and commonly associated sulfides including pyrite, marcasite, pyrrhotite, cobalt and the like.

Any inert, non-oxidizing gas may be used with the present inventive process but nitrogen, argon, $CO_2$, $SO_2$ or admixtures thereof are particularly suitable. It will be understood that the term "inert, non-oxidizing gas" used throughout this specification refers to commercial grades of such gases. In a preferred embodiment, the conditioning substance comprising at least one of an inert, non-oxidizing gas and the reducing, deoxifying agent are added to the slurry in a quantity sufficient to produce a dissolved oxygen content of less than 1 ppm. In another preferred embodiment, the conditioning substance is added in an amount sufficient to produce an electrochemical potential of between 0 to −700 mV, more preferably between −100 mV and −500 mV, which is conducive to depression of the non-sulfidic "gangue" minerals.

Suitable reducing, deoxifying agents include sulfoxy agents, SBS (sodium bisulfite), MBS (metabisulfites), sulfites, their potassium, calcium or ammonium salts, NaSH, $Na_2S$ and the like and organic depressants for naturally floating minerals such as carboxy methyl cellulose, dextran, guar gum, derivatives thereof and mixtures thereof.

The applicants have found that the present inventive process provides improved oxygen removal from surfaces of non-sulfide gangue minerals thereby increasing gangue mineral rejection and improving valuable sulfide, particularly nickel, flotation metallurgy e.g. better concentrate grade in the flotation circuit. It has also been found that the present inventive process increases non-sulfide gangue mineral rejection and rejection of MgO, if present, while maintaining existing valuable sulfide mineral, specifically nickel, recovery.

The present inventive process may be used for conditioning a freshly milled slurry or a slurry of a flotation concentrate from a previous flotation cell that has been exposed to reagents including collectors, frothers, activators and organic depressants and the like. According to the present invention, such a slurry is conditioned with a conditioning substance comprising at least one of nitrogen and a reducing agent, e.g. an NaSH group, for a specific conditioning period prior to flotation to provide a controlled dissolved oxygen content or electrochemical reduction potential suitable for floating the valuable sulfidic minerals and sinking the non-sulfidic gangue minerals. Preferably, the conditioning period is between one and six minutes.

Subsequent flotation is then carried out preferably using nitrogen as the carrier gas. This process improves the selectivity between valuable sulfides and non-sulfide gangue minerals thereby improving the concentrate grade of the valuable sulfide at the same recovery levels and improving rejection of the non-sulfide "gangue" mineral.

The present invention will now be described by way of example only with reference to the accompanying FIG. 1 which is a flow diagram of a typical flotation circuit in accordance with an embodiment of the present invention. As shown in FIG. 1, the present invention is particularly suitable for, but not limited to, the final cleaning/scavenger circuits in which the valuable concentrate from the previous flotation circuit is dosed with a suitable reducing, deoxifying agent, such as NaSH or $Na_2S$, and subjected to final flotation with nitrogen gas. The nitrogen gas and NaSH-type reducing agent effectively suppress flotation of the non-sulfidic gangue minerals thereby increasing the recovery of the valuable sulfidic mineral.

EXAMPLE 1

$N_2$/NaSH conditioning with nitrogen flotation.

By way of example, two tests were conducted in which 1 kg charges of crushed ore containing disseminated nickel sulfide were slurried in salt water to obtain a pulp density of 60 wt % solids and milled in a stainless steel rod mill employing stainless steel rods to achieve P80 of approximately 160 microns. An appropriate quantity of a collector, e.g. sodium ethyl xanthate, was added to the mill.

The milled slurry was then repulped and deslimed in the 25 mm diameter Mosley cyclone. The cyclone underflow stream was collected for flotation testing.

The deslimed milled slurry was transferred to a 2.5 litre Denver flotation cell. Frother and additional collector was added and the slurry was conditioned for a period of time prior to flotation.

Flotation with air was commenced and a rougher concentrate and scavenger concentrate were produced from 3 and 27 minutes respectively of flotation. Additional collector and frother was added during flotation. The scavenger concentrate was then reflotated in 0.5 Denver cell at 700 rpm according to the following two methods:

Test A—Control Tests Using Air As The Flotation Gas Scavenger Concentrate Stage Reflotation Performance

| | Assay | | Distribution (%) | | |
|---|---|---|---|---|---|
| Product | Ni | MgO | Wt | Ni | MgO |
| Conc 1 | 5.63 | 28.9 | 1.9 | 4.7 | 1.6 |
| Conc 1 + 2 | 6.53 | 27.5 | 7.7 | 22.2 | 6.1 |
| Conc 1 + 2 + 3 | 6.20 | 27.5 | 20.4 | 56.1 | 16.3 |
| Feed | 2.25 | 34.3 | | | |

Test B—Test Using $N_2$/NaSH Conditioning Followed By Flotation With $N_2$ Gas.

In accordance with the present invention, in this test the scavenger concentrate was conditioned in a 0.5 L Denver cell at 700 rpm for 2.5 minutes with 1 L/min of nitrogen gas and NaSH additions as the reducing, de-oxifying agent. The NaSH addition was controlled by measuring and maintaining the sulfide potential (Es) at approximately −500 mV. Flotation with nitrogen was commenced after conditioning.

Scavenger Concentrate Stage Reflotation Performance

| | Assay | | Distribution (%) | | |
|---|---|---|---|---|---|
| Product | Ni | MgO | Wt | Ni | MgO |
| Conc 1 | 9.63 | 23.2 | 3.2 | 11.6 | 2.2 |
| Conc 1 + 2 | 9.78 | 22.7 | 10.1 | 37.7 | 6.8 |
| Conc 1 + 2 + 3 | 8.02 | 25.2 | 21.8 | 67.1 | 16.3 |
| Feed | 2.61 | 33.8 | | | |

Conc 1 is the first concentrate floated in the flotation test. Conc 1+2 and Conc 1+2+3 are the combination of the first and second concentrates, and first, second and third concentrates, respectively, floated in the flotation test. It is clear from the above results that Test B, using the inventive conditioning step provides a higher concentrate nickel grade and higher flotation recovery of nickel with a lower concentrate of MgO grade.

EXAMPLE 2

Nitrogen Conditioning With Nitrogen Flotation

In this example, two tests were conducted where 1 kg charges of crushed ore containing disseminated nickel sulfides were slurried in salt water and ground in similar equipment as example 1 to achieve P80 of 75 microns.

The milled slurry was then transferred to 2.5 L Denver flotation cell and floated in a manner similar to example 1 to produce a rougher concentrate and scavenger concentrate.

The scavenger concentrate was then refloated in a 0.5 L Denver flotation cell as discussed in example 1.

Test C—Control Test Using Air As The Flotation Gas

Scavenger Concentrate Stage Reflotation Performance

| | Assay | | Distribution (%) | | |
|---|---|---|---|---|---|
| Product | Ni | MgO | Wt | Ni | MgO |
| Conc 1 | 2.47 | 34.8 | 3.1 | 4.0 | 3.0 |
| Conc 1 + 2 | 3.29 | 33.5 | 11.1 | 19.0 | 10.5 |
| Conc 1 + 2 + 3 | 4.50 | 31.7 | 20.1 | 47.2 | 18.1 |
| Feed | 1.92 | 35.3 | | | |

Test D—Test Using $N_2$ Conditioning Followed By Flotation With $N_2$ Gas

In this test, the scavenger concentrate was conditioned in a 0.5 L Denver flotation cell with 1 L/min nitrogen gas addition. Flotation with nitrogen was commenced after conditioning.

Scavenger Concentrate Stage Reflotation Performance

| | Assay | | Distribution (%) | | |
|---|---|---|---|---|---|
| Product | Ni | MgO | Wt | Ni | MgO |
| Conc 1 | 2.94 | 33.7 | 3.0 | 4.2 | 2.9 |
| Conc 1 + 2 | 4.06 | 32.3 | 10.8 | 21.0 | 10.0 |
| Conc 1 + 2 + 3 | 5.09 | 30.7 | 23.2 | 56.5 | 20.4 |
| Feed | 2.10 | 35.0 | | | |

The test data indicate a slightly higher concentrate nickel grade, higher flotation recovery of nickel and a slightly lower concentrate MgO grade in test D using the nitrogen conditioning step followed by nitrogen gas flotation.

EXAMPLE 3

Nitrogen Flotation

In this example, two tests were conducted on fresh samples of reagentized flotation plant feed slurry from an ore containing a mixture of massive and disseminated nickel sulfide. This slurry assayed 1.7% nickel and 24% MgO.

The slurry was transferred to a 2.5 L laboratory flotation cell and flotated according to the following operations and reagent additions.

| Operation | Time Minutes | Guar Addition, gpt | SEX Addition gpt |
|---|---|---|---|
| Conditioning | 2 | 30 | — |
| Flotation - Concentrate 1 | 4 | — | — |
| Conditioning | 2 | — | 2 |
| Flotation - Concentrate 2 | 4 | — | — |
| Conditioning | 2 | 10 | — |
| Conditioning | 2 | — | 2 |
| Flotation - Concentrate 3 | 4 | — | — |
| Conditioning | 2 | — | 2 |
| Flotation - Concentrate 4 | 4 | — | — |

SEX - Sodium Ethyl Xanthate

Each test produced four flotation concentrates and one flotation tail.

Test E—Control Test Using Air As The Flotation Gas

Flotation Feed Stage Flotation Performance

| | Assay | | Distribution (%) | | |
|---|---|---|---|---|---|
| Product | Ni | MgO | Wt | Ni | MgO |
| Conc 1 | 8.30 | 12.2 | 15.6 | 77.6 | 8.0 |
| Conc 1 + 2 | 6.36 | 15.5 | 22.7 | 86.5 | 14.8 |
| Conc 1 + 2 + 3 | 5.70 | 16.4 | 26.3 | 89.7 | 18.2 |
| Conc 1 + 2 + 3 + 4 | 5.34 | 17.1 | 28.5 | 91.0 | 20.4 |

Test F—Test Using $N_2$ For Flotation Gas

Flotation Feed Stage Flotation Performance

| | Assay | | Distribution (%) | | |
|---|---|---|---|---|---|
| Product | Ni | MgO | Wt | Ni | MgO |
| Conc 1 | 11.00 | 8.40 | 11.3 | 72.7 | 3.9 |
| Conc 1 + 2 | 8.61 | 11.9 | 16.8 | 84.6 | 8.3 |
| Conc 1 + 2 + 3 | 7.33 | 13.5 | 20.8 | 89.0 | 11.6 |
| Conc 1 + 2 + 3 + 4 | 6.65 | 14.6 | 23.3 | 90.6 | 14.1 |

The above test data clearly indicates higher concentrate nickel grade and lower concentrate MgO grade in Test F than Test E.

It will be understood by persons skilled in the art that the present invention may be embodied in forms other than that shown in the present invention without departing from the spirit or scope of the present invention.

We claim:

1. A process of treating a milled slurry or a slurry of a flotation concentrate consisting essentially of a mixture of sulfidic mineral, with or without precious metals, and non-sulfidic gangue material, comprising conditioning the slurry with an inert gas selected from the group consisting of nitrogen, argon and neon and a reducing, deoxifying agent selected from the group consisting of sulfoxy agents, metabisulfites, sulfites and their potassium, calcium and ammonium salts, sodium bisulfite, sodium bisulfide, sodium sulfide, carboxymethylcellulose, dextran, guar gum and mixtures thereof, thereby achieving a controlled dissolved oxygen content of less than 1 ppm or an electrochemical potential of between about 0 and −700 mV, conductive to the flotation of the sulfidic material from the non-sulfidic gangue material by reducing the floatability of the gangue material, followed by flotation of the valuable sulfidic mineral from the non-sulfidic gangue material using an inert gas as the flotation gas thereby achieving an enhanced concentration grade of the valuable sulfidic material at a given recovery level, said conditioning step being conducted prior to or simultaneously with the flotation step.

2. A process in accordance with claim 1, wherein the conditioning substance is added in a quantity sufficient to produce an electrochemical potential of the slurry of −100 mV to −500 mV.

3. A process in accordance with claim 1, wherein the sulfidic mineral is selected from the group consisting of minerals of nickel, copper, precious metals, cobalt; and pyrite, marcasite, and pyrrhotite.

4. A process in accordance with claim 1, wherein said non-sulfidic gangue materials is selected from the group consisting of magnesium-bearing minerals, talc, lizardite, brucite, antigorite, chlorite, micas, and amphiboles.

5. A process in accordance with claim 1, wherein said conditioning step is carried out for from 1 to 6 minutes.

6. A process in accordance with claim 1, wherein the inert gas is nitrogen.

* * * * *